US011655946B1

(12) United States Patent
Zhang

(10) Patent No.: US 11,655,946 B1
(45) Date of Patent: May 23, 2023

(54) FLEXIBLE LED ILLUMINATION DEVICE

(71) Applicant: Bruce Zhang, Orlando, FL (US)

(72) Inventor: Bruce Zhang, Orlando, FL (US)

(73) Assignee: Bruce Zhang, Orlando, FL (US)

( * ) Notice: Subject to any disclaimer, the term of this patent is extended or adjusted under 35 U.S.C. 154(b) by 0 days.

(21) Appl. No.: 17/979,832

(22) Filed: Nov. 3, 2022

Related U.S. Application Data

(60) Provisional application No. 63/353,328, filed on Jun. 17, 2022.

(51) Int. Cl.
*F21S 4/26* (2016.01)
*F21Y 103/10* (2016.01)
*F21Y 115/10* (2016.01)

(52) U.S. Cl.
CPC ..... *F21S 4/26* (2016.01); *F21Y 2103/10* (2016.08); *F21Y 2115/10* (2016.08)

(58) Field of Classification Search
CPC ..... F21S 4/26; F21S 4/24; F21S 4/22
See application file for complete search history.

(56) References Cited

U.S. PATENT DOCUMENTS 7,850,341 B2 * 12/2010 Mrakovich ..... F21S 4/22 362/555
2003/0223235 A1 * 12/2003 Mohacsi ..... F21S 4/20 362/240
2005/0092517 A1 * 5/2005 Fan ..... F21S 4/24 174/117 FF
2005/0213321 A1 * 9/2005 Lin ..... F21S 4/26 362/231
2005/0231947 A1 * 10/2005 Sloan ..... G09F 9/33 362/235
2016/0025278 A1 * 1/2016 Camarota ..... F21V 15/012 29/428

FOREIGN PATENT DOCUMENTS

WO WO-2008014682 A1 * 2/2008 ..... F21S 4/26

OTHER PUBLICATIONS

Machine translation of Yao, WO 2008/014682, published Feb. 7, 2008 (Year: 2008).*

* cited by examiner

*Primary Examiner* — William N Harris

(57) ABSTRACT

A Flexible LED illumination device, according to the present invention, comprises a translucent positioning strip having a plurality of slots disposed at the center, a plurality of light modules mounted inside of the translucent positioning strip, a plurality of power conductors in communication to the plurality of light modules, a translucent housing covering the plurality of light modules, an elongated light diffuser tube disposed at the top of the translucent housing, and wherein said elongated light diffuser tube is configured to refract light from the plurality of light modules, a potting glue disposed at the bottom of the plurality of power conductors, and exposed power conductors extruding in between the plurality of light modules. The flexible LED illumination device is constructed with flexible material to allow bending to any shapes, and weatherproofing.

5 Claims, 16 Drawing Sheets

FLEXIBLE LED ILLUMINATION DEVICE

CROSS-REFERENCE TO RELATED APPLICATIONS

This application claims the benefit of Applicant's prior provisional application, number U.S. 63/353,328 filed on Jun. 17, 2022, the contents of which are incorporated by reference in their entirety.

TECHNICAL FIELD OF THE INVENTION

The present invention relates to lighting devices or systems using a strip of light sources with light sources held by or within elongated flexible supports. More particularly, the present invention relates to a flexible LED illumination device.

BACKGROUND OF THE INVENTION

Neon lighting has been used extensively by advertisers and business establishments to convey information to the public for decades. Such systems are popular due to the bright, uniform, and colorful light distribution emitted from the lights.

Although popular, such systems are extremely labor intensive because each light must be individually constructed to form a shape within a sign or other such system. For example, to construct a segment of a neon sign, an artisan must go through the laborious process of heating lead glass tubing, shaping the tube into the desired form, and then attaching an electrode to each end of the tube. The artisan must then evacuate air and impurities from the tube and introduce gas such as Neon, Krypton, Xenon, Argon, or Helium. Finally, after each individual light segment of the neon sign has been formed, the artisan must assemble the segments into a single structure and must then wire each segment to a step-up transformer that typically increases the voltage from 120 volts to somewhere between 3,000 and 15,000 volts.

Conversely, Light Emitting Diodes (LEDs) convert electrical energy into distinct light colors of light. Advances in LED technology and material science have enabled semiconductor manufacturers to create very bright LEDs in various colors. LED lighting offers numerous advantages over neon lighting. LEDs do not require transformers that step-up voltages to dangerous levels instead, LEDs operate at potentials of 3 to 24 volts. LEDs can easily package in various safe materials and do not require large breakable tubular lead crystal structures. LED brightness can easily be controlled with a very quick response allowing for visual effects not possible with neon lights. LEDs may also be produced at a low cost.

Those concerned with using neon signs have long recognized the need for more controllable, safer, less fragile, and less expensive neon signs. Several prior arts were made to solve the pertinent technical problem. The invention with U.S. Pat. No. 7,850,341 B2 discloses an Elongated LED Illumination Device, which provides a LED strip that simulates the features of a neon sign. The illumination device is flexible and can be bent into shapes, letters, and other designs. However, the assembly of inserting a plurality of LED assemblies into the light guide is vulnerable to skid due to the tension during bending. Also, in another embodiment of the invention, the light guide is rigid in structure and requires extreme heat to bend it; thus, the bending process can't be done on-site. Lastly, one of the disadvantages of said invention is that it cannot be cut to match the length of a building's structural features or design parameters.

U.S. Pat. No. 10,520,143 B1 discloses a LED simulated Neon with structural reinforcement. Said invention provides strain relief to the linear lighting within the simulated neon. Moreover, said invention imparts teaching of a flexible covering with a translucent upper portion and an opaque lower portion. The covering is a flexible material and can be cut at specific points within. However, the invention failed to disclose whether the remainder of the linear lighting could be reconnected for an electrical connection.

U.S. Pat. No. 7,604,376 B2 discloses a flexible perimeter lighting apparatus which is an elongated flexible lighting system that comprises an array of light sources that are disposed inside of an elongated translucent extrusion flexible material. Said prior art provides the teaching of being able to cut to match the length of a particular structural feature. In the present embodiments of the invention, mounting pads are required to reconnect the electrical coupling to the DC power supply. Said feature is disadvantageous since a particular connector is vital to re-establish an electrical connection. Moreover, installing LEDs and circuit boards inside the elongated translucent extrusion flexible material is challenging since they must be covered by potting material.

The present invention directed to a Flexible LED Illumination Device differs from the teachings provided by the aforementioned prior arts.

SUMMARY OF THE INVENTION

The present invention relates to lighting devices or systems using a strip of light sources with light sources held by or within elongated flexible supports. More particularly, the present invention relates to a flexible LED illumination device.

In one embodiment of the invention, a flexible LED illumination device comprises a translucent positioning strip having a plurality of slots disposed at the center, a plurality of light modules, and wherein said plurality of light modules further comprises a plurality of LEDs being mounted at the top surface of a circuit board, a power terminal for electricity connection being disposed at the bottom of the circuit board, and a current regular mounted at the surface of the circuit board, a plurality of power conductors attached to the power terminal and said power conductor being configured to connect the plurality of light modules to a power source. The plurality of power conductors for this embodiment comprises a pair of conductors for the transmission of electricity. Also, the embodiment comprises a translucent housing being molded to cover the top and sides of the translucent positioning strip, the plurality of light modules, an elongated light diffuser tube disposed at the top of the translucent housing, and wherein said elongated light diffuser tube being configured to diffused light from the plurality of LEDs simulating a neon sign, a potting glue disposed at the bottom of the translucent housing and covering the plurality of power conductors. An exposed power conductor extruding in between the plurality of light modules, and wherein said exposed wire is being configured for electrical connection means during the installation process.

One embodiment of the flexible LED illumination device comprises a plurality of power conductors with a quintet of conductors. Said quartet of conductors is structured to accommodate red, green, blue, and white backlight produced by the plurality of light modules. Also, the embodiment comprises of translucent positioning strip, translucent housing, elongated light diffuser tube, and potting glue.

These and other features and advantages of the invention will be apparent to those skilled in the art from the following detailed description, taken together with the accompanying drawings.

BRIEF DESCRIPTION OF DRAWINGS

The present invention will be better understood by reference to the accompanying drawings, which.

DETAILED DESCRIPTION OF THE INVENTION

Before describing the present invention in detail, it is to be understood that the phraseologies and terminologies used herein are for the purpose of description and should not be regarded as limiting.

It will be understood that, although the terms first, second, third, etc. may be used to describe various elements, these elements should not be limited by these terms. These terms may be used to distinguish one element from another. For example, a first element may be termed a first element without departing from the scope of the present invention. As used herein, the term "and/or" may include any and all combinations of one or more of the associated listed items.

Figure 1:
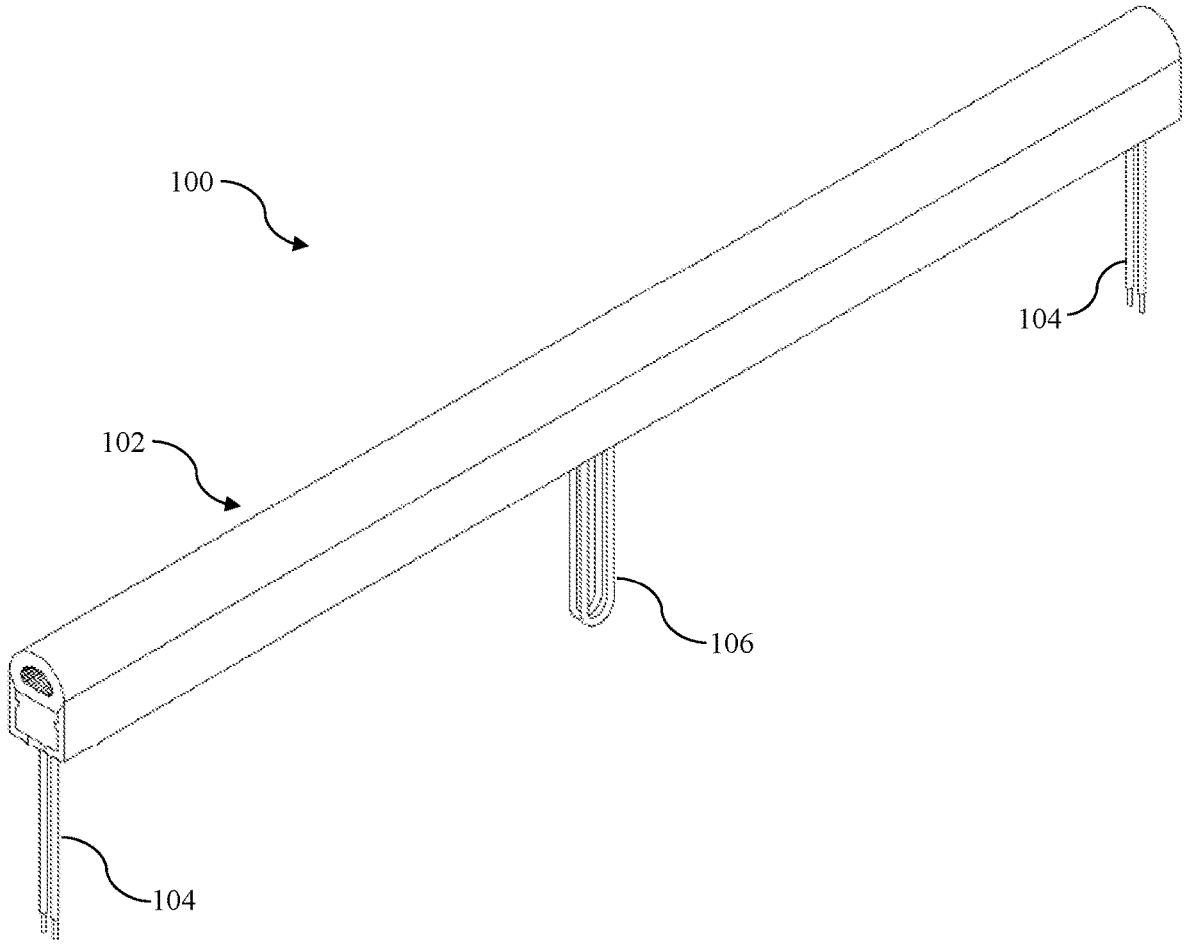
FIG. 1 is a perspective of one embodiment of a flexible LED illumination device according to the present invention.

Referring now to the drawings, wherein, like reference numerals designate the components or elements throughout the ensuing enabling description, the present invention provides a flexible LED illumination device regarded as 100. With reference to FIG. 1, the flexible LED illumination device 100 comprises an elongated light diffuser tube 102, a plurality of power conductors 104, and an exposed power conductors 106. The flexible LED illumination device 100 is configured to be flexible and be bent into any shape to accommodate different design parameters as expected in the field. As viewed in FIG. 1, the plurality of power conductors 104 and exposed power conductors 106 are extruding at the bottom of the flexible LED illumination device 100. During installation, the flexible LED illumination device 100 is adept at being cut into a plurality of segments. The plurality of power conductors 104 is configured as the primary input and termination connection of the power source of the flexible LED illumination device 100. Moreover, the exposed power conductors 106 is configured as a jumping wire for $1^{st}$ embodiment of the flexible LED illumination device 100, which can serve as a new primary input of power when the flexible LED illumination device 100 is sliced into smaller segments.

Figure 2:
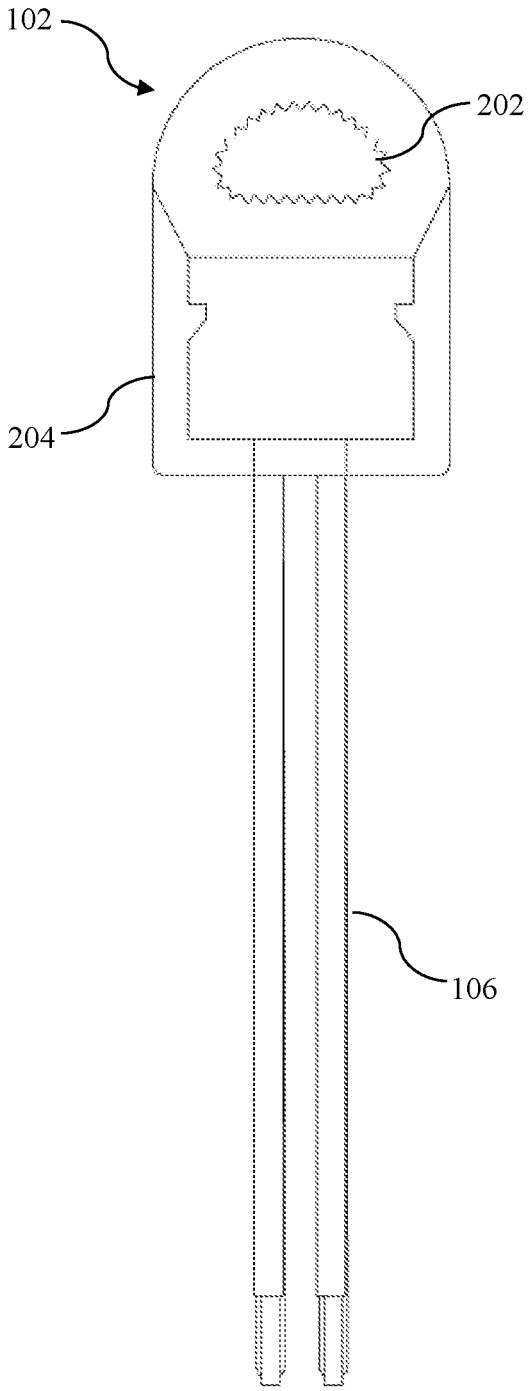
FIG. 2 is a front view of one of the embodiments of the flexible LED illumination device according to the present invention.

As seen in FIG. 2, the elongated light diffuser tube 102 further comprises an air gap 202 disposed at the middle or at the cross-center section of the elongated light diffuser tube 102. The air gap is provided in the elongated light diffuser tube 102 to diffuse and further refract light emitted from the plurality of LEDs 304 (not shown). The elongated light diffuser tube 102 can include any number of different shapes and can be constructed from different materials having varying levels of opaqueness.

Going back to FIG. 2, the flexible LED illumination device 100 further comprises a translucent housing 204. The translucent housing 204 is provided to cover the sides and a portion of the bottom of the flexible LED illumination device 100. Said translucent housing 204 is attached at the bottom of the elongated light diffuser tube 102. The translucent housing 204 is configured to protect the components within the flexible illumination device 100 from being stretched, provide another protective layer, and provide weatherproofing. Although described above with regard to specific shapes, sizes, materials, or intended uses, this is for illustrative purposes only. To this end, other embodiments are contemplated wherein one or more of the device components are formed from other materials or include different shapes, sizes, or components than those described or include different shapes, sizes, or components than those described or illustrated. With this, the elongated light diffuser tube 102 is given with a semi-circle cross section for efficient refraction of light emitted and simulates a Neon tube.

Figure 3:
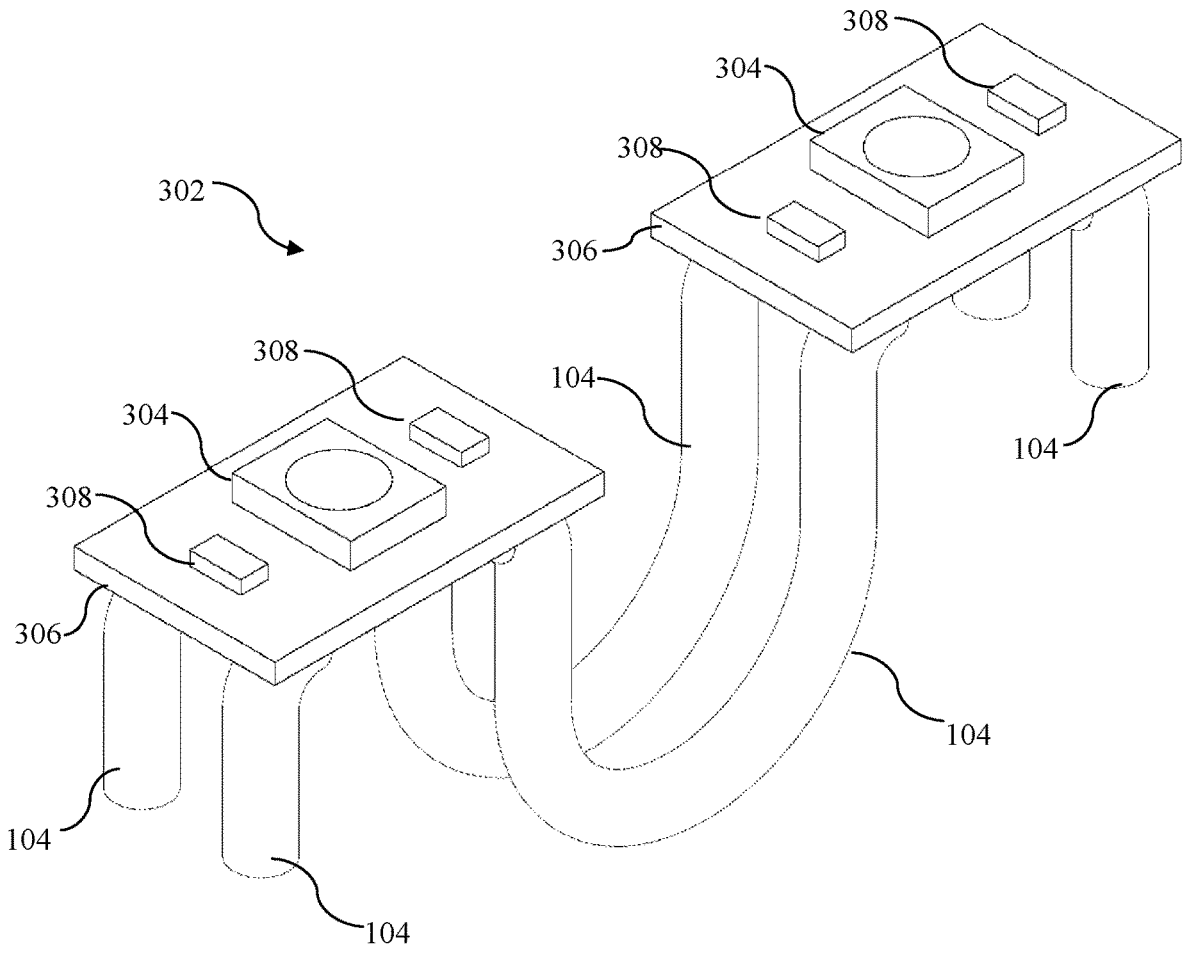
FIG. 3 is a perspective view of a plurality of LED modules of one of the embodiments of the flexible LED illumination device.

With reference to FIG. 3, a plurality of light modules 302 further comprises a plurality of LEDs 304 attached to the top surface of a circuit board 306. Furthermore, a plurality of resistors 308 is being mounted at the surface of the circuit board 306 to protect the plurality of light modules 302 from a current surge.

Figure 4:
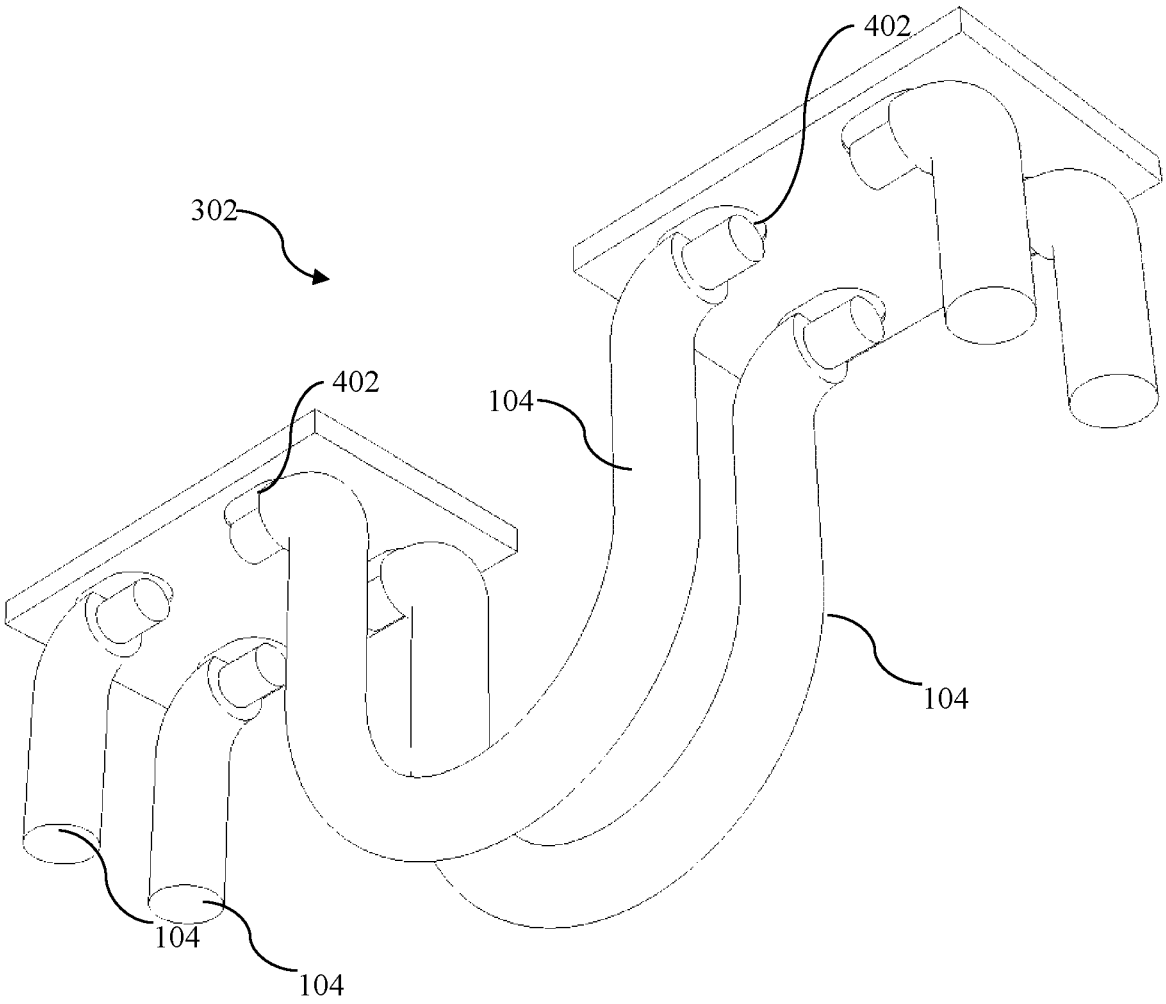
FIG. 4 is a projected view of the plurality of LED modules of one of the embodiments of the flexible LED illumination device.

The plurality of light module 302 is arranged in a longitudinal direction of the translucent housing 204, and connected with each other through the plurality of power conductors 104, as shown in FIG. 3. Furthermore, said plurality of power conductors 104 are being attached to the power terminal 402 located at the bottom of the circuit board 306, as shown in FIG. 4.

Figure 5:
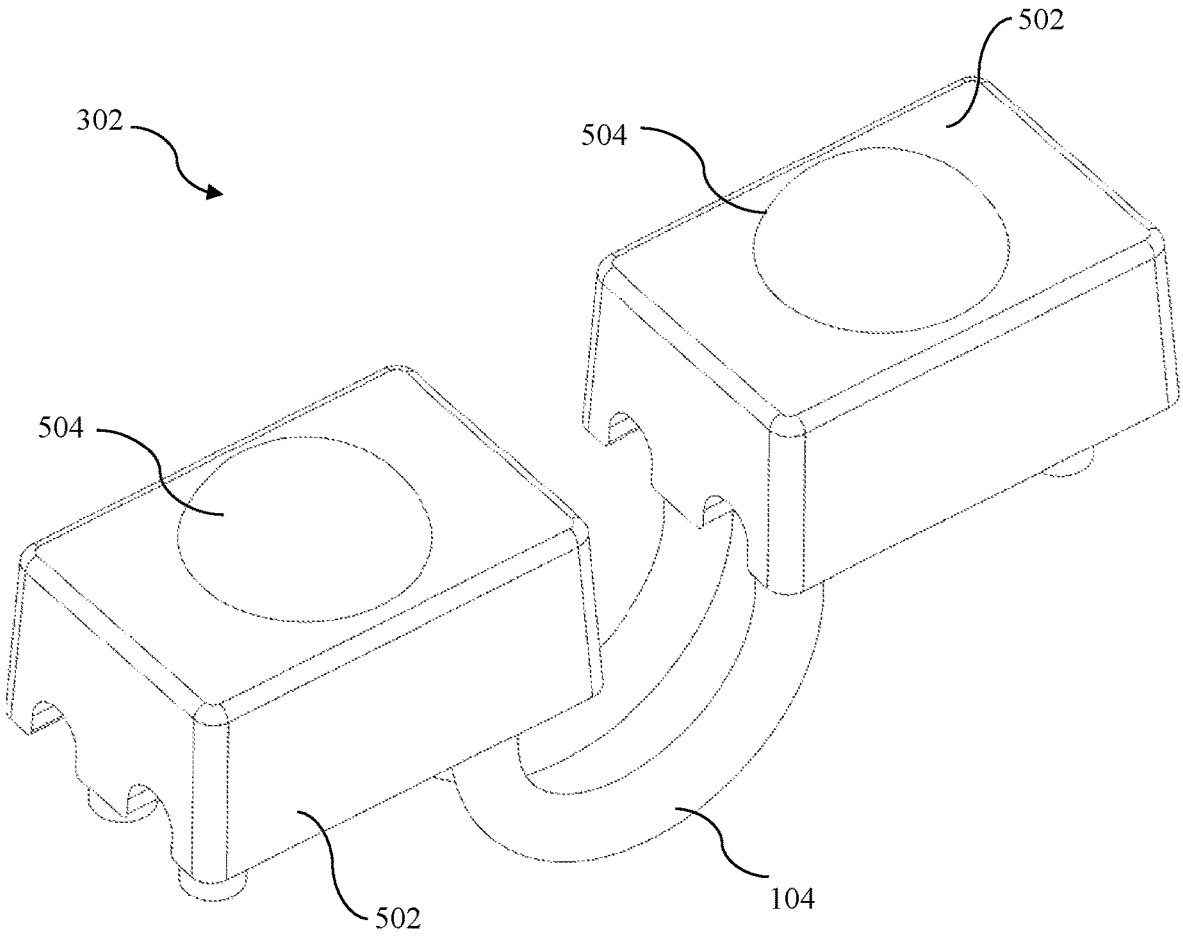
FIG. 5 is a perspective of view of another embodiment of the plurality of LED modules.
Figure 6:
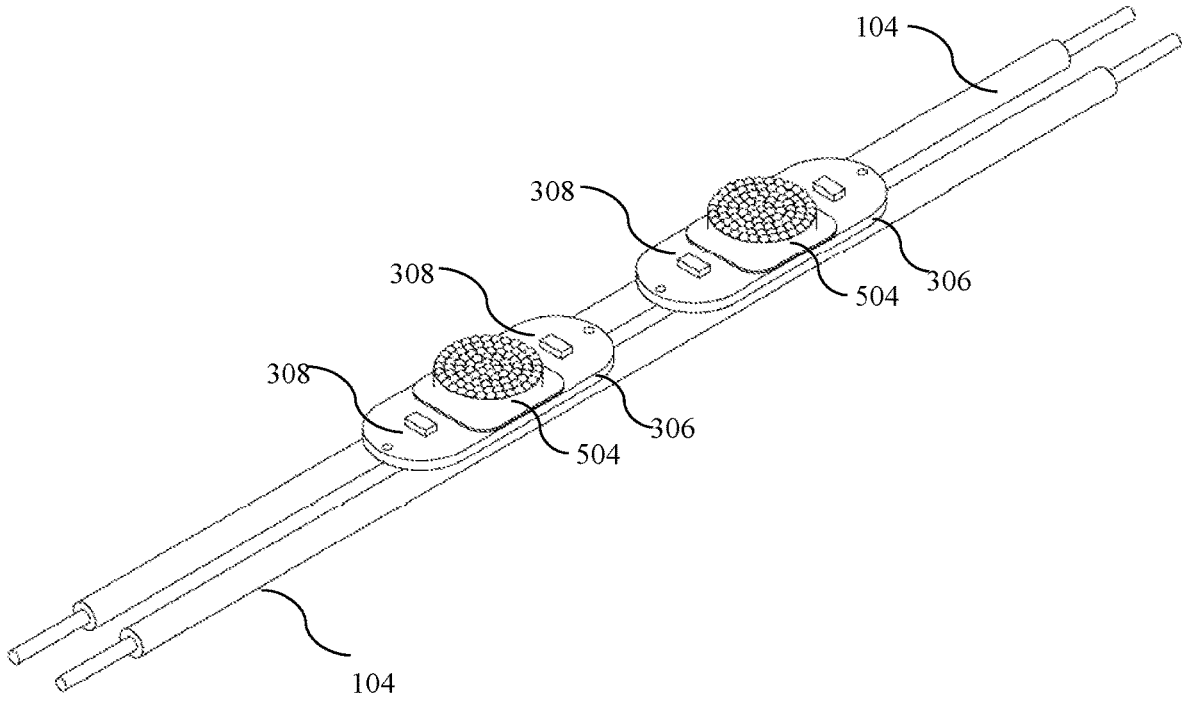
FIG. 6 is a perspective of view of the $3^{rd}$ embodiment of the plurality of LED modules.
Figure 7:
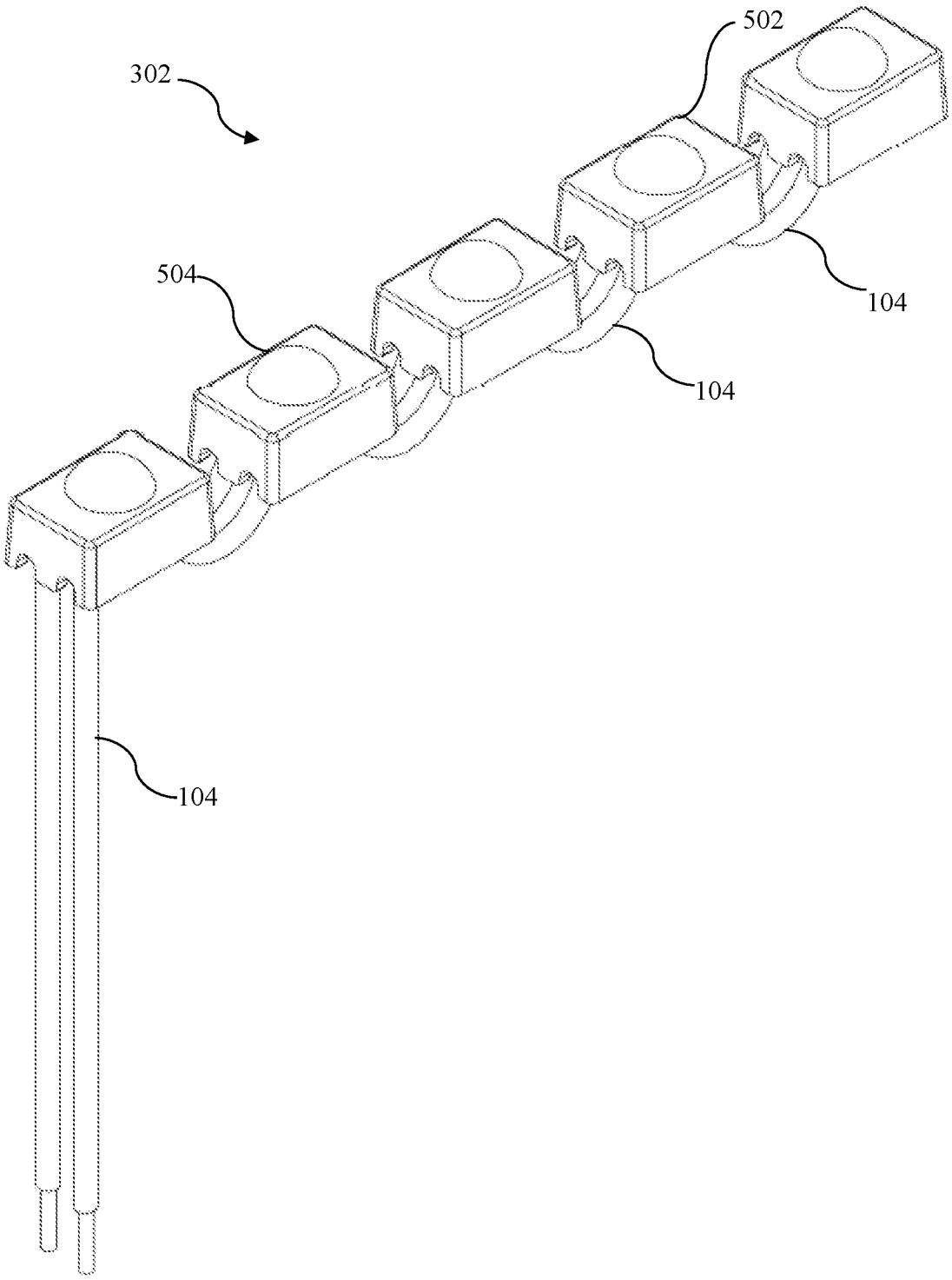
FIG. 7 is an illustrative view of the electrical connection of the $2^{nd}$ embodiment of the plurality of LED modules.

In another embodiment of the plurality of light module 302, shown in FIG. 5, the plurality of light module 302 is provided with a shell 502 to further protect the plurality of LEDs 304, the circuit board 306, and the current regulator 308 from impact, damage, moisture, and water leak. The embodiment provides an optical lens 504 to further enhance the reflection of light from the plurality of LEDs 304. In another embodiment of the optical lens 504, a pattern of geometrical shapes is disposed on top of the optical lens 504 for better refraction and reflection of light from the plurality of LEDs 304, as shown in FIG. 6. The same with the original embodiment, the current embodiments of the plurality of light module 302 is connected through the plurality of power conductors 104 as shown in FIG. 6 and FIG. 7.

Figure 8:
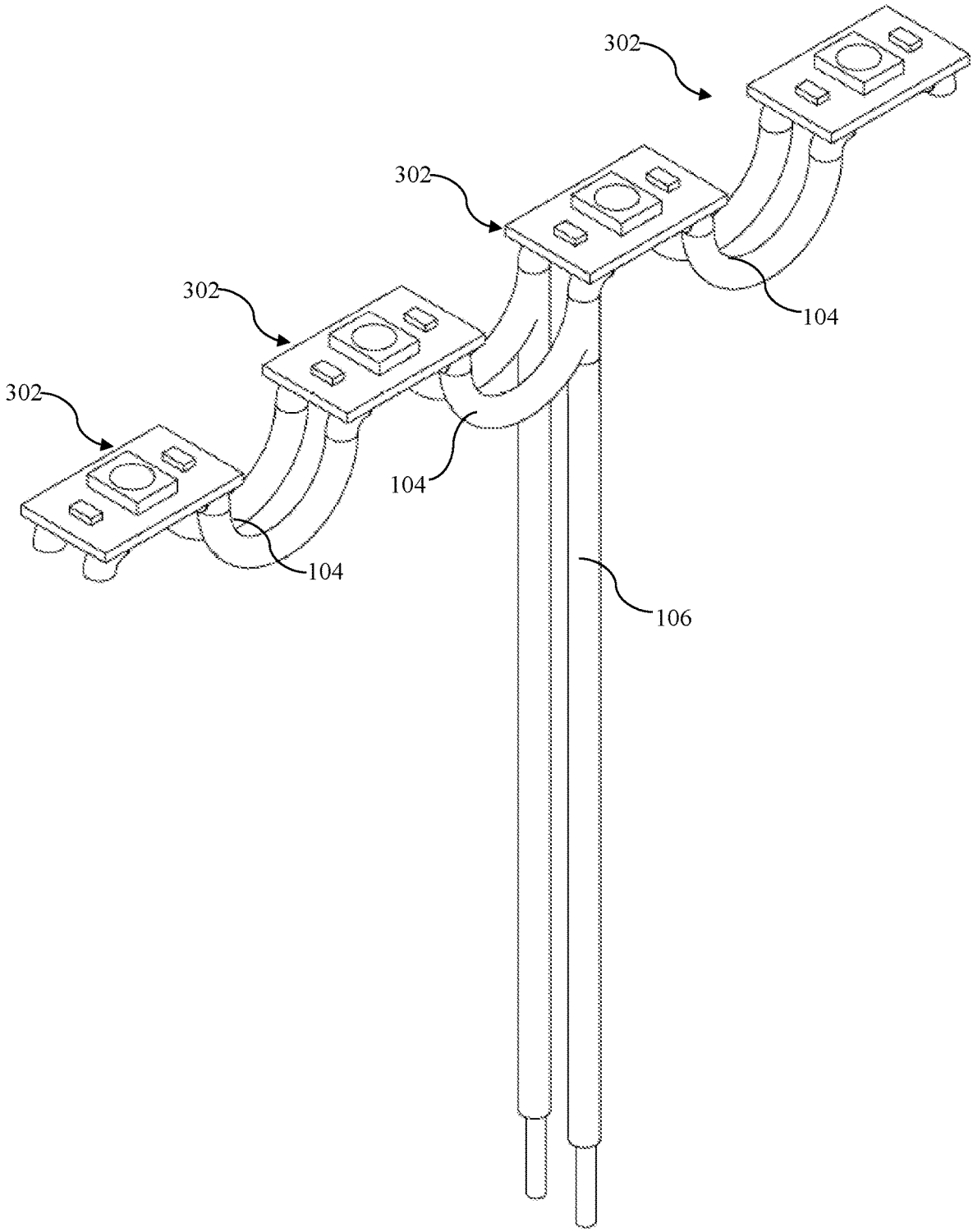
FIG. 8 is an illustration of another embodiment of the exposed power conductors.
Figure 9:
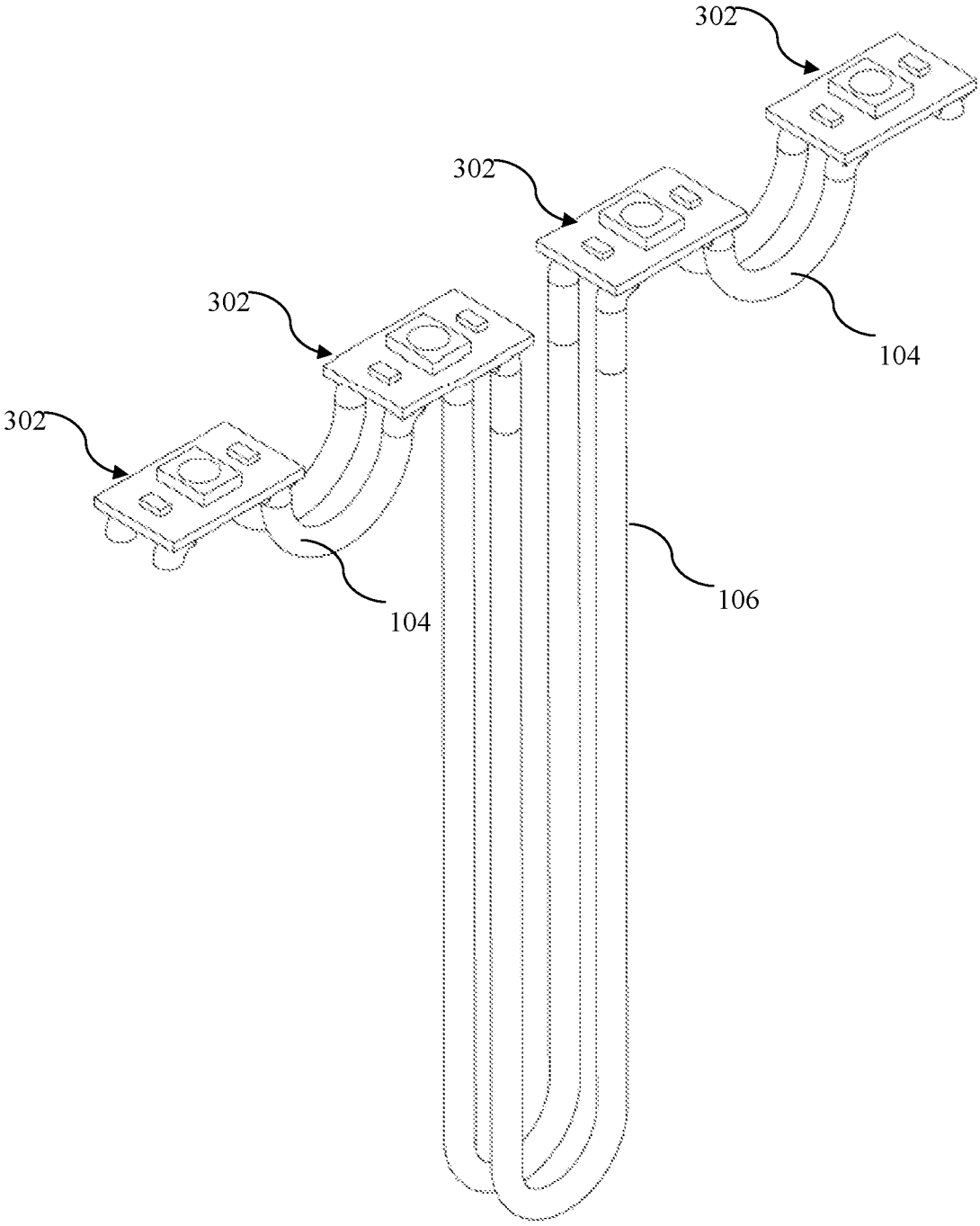
FIG. 9 is a perspective view of the $1^{st}$ embodiment of the exposed power conductors.

In the illustration supplied by FIG. 8, an embodiment of the exposed power conductors 106 are provided. Said exposed power conductor 106 is unitary with the plurality of power conductors 104. Unlike in the original embodiment, as shown in FIG. 9, the exposed power conductor is a U-shaped jumper connector.

Figure 10:
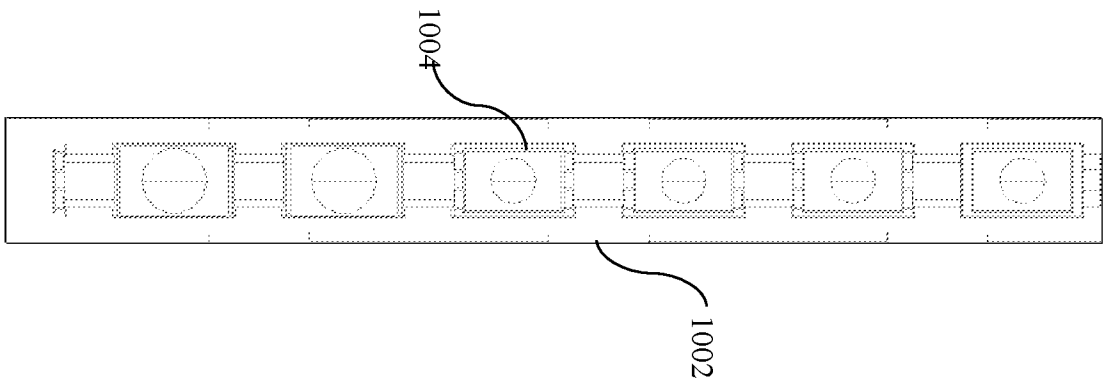
FIG. 10 is a bottom view of a translucent positioning strip with a plurality of slots.
Figure 11:
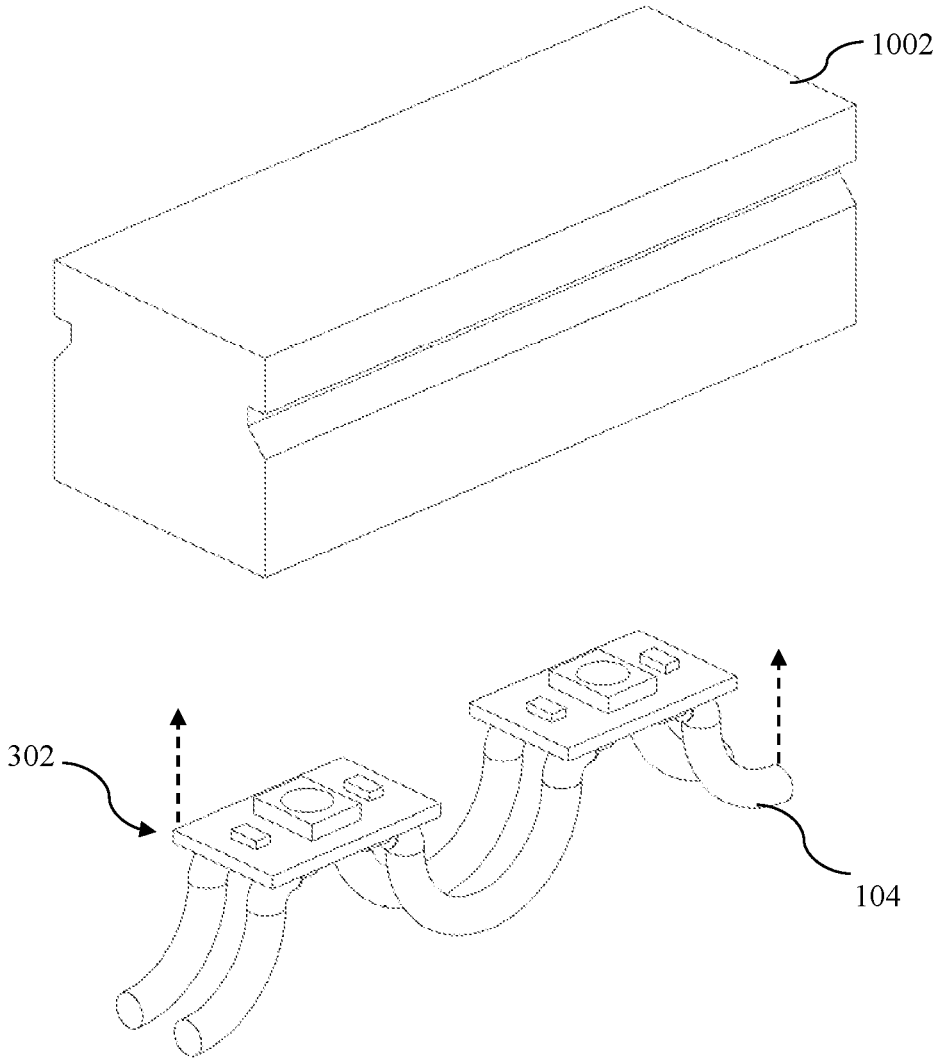
FIG. 11 is a perspective view of the translucent positioning strip, and the plurality of LED modules during assembly.
Figure 12:
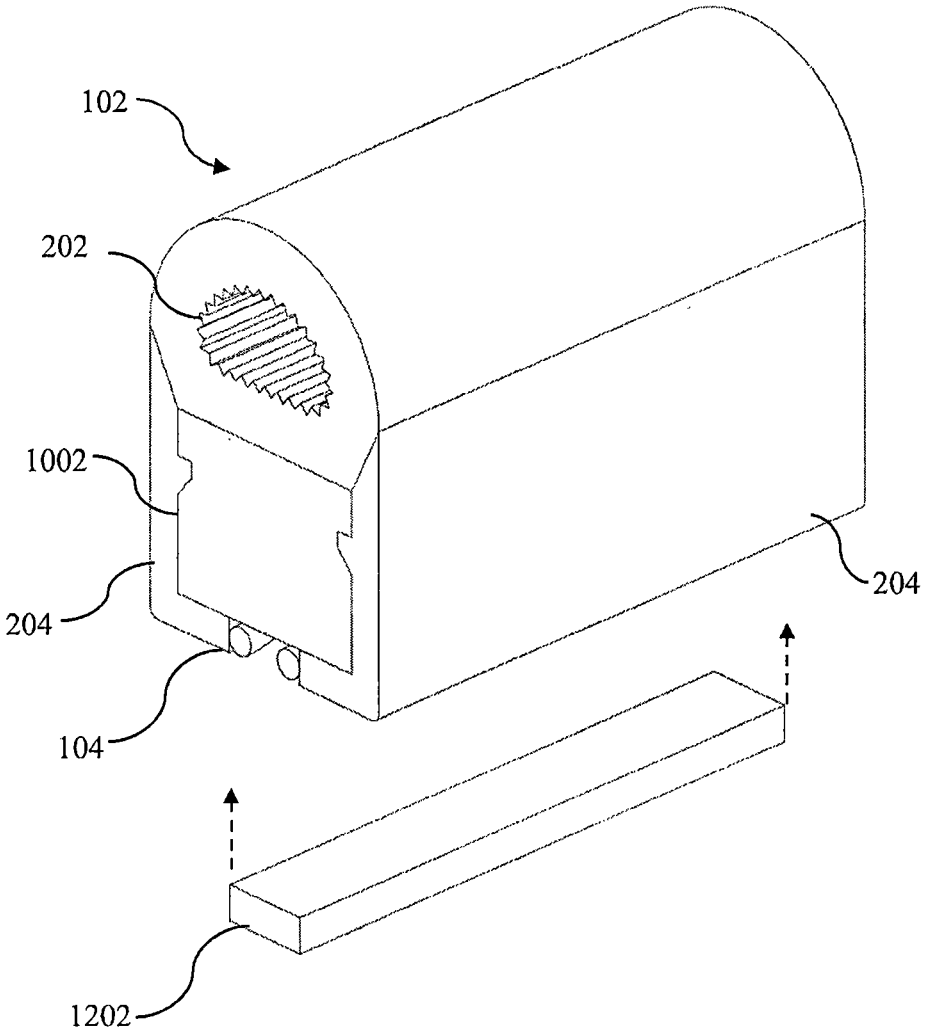
FIG. 12 is an isometric view of attaching the potting glue to the flexible LED illumination device.

FIG. 10 shows a bottom view of a translucent positioning strip 1002. The translucent positioning strip 1002, an extruded silicone flex strip, is configured to hold and protect the plurality of light modules 302 and the plurality of power conductors 104. The plurality of light modules 302 is slotted to the translucent positioning strip 1002 through the plurality of slots 1004. Said insertion of the plurality of modules 302 to the plurality of slots 1004 is viewed in FIG. 11. Furthermore, a potting glue 1202 is disposed at the bottom of the translucent housing 204 and covers the plurality of power conductors 104 as shown in FIG. 12. During assembly, the translucent positioning strip 1002, the plurality of light modules 302, and potting glue 1202 are attached to firmly secure the attachments and additional feature for weatherproofing. Lastly, the elongated light diffuser tube 102 is fixed on top of the translucent positioning strip 1002 to complete the original embodiment of the flexible LED illumination device 100.

Figure 13:
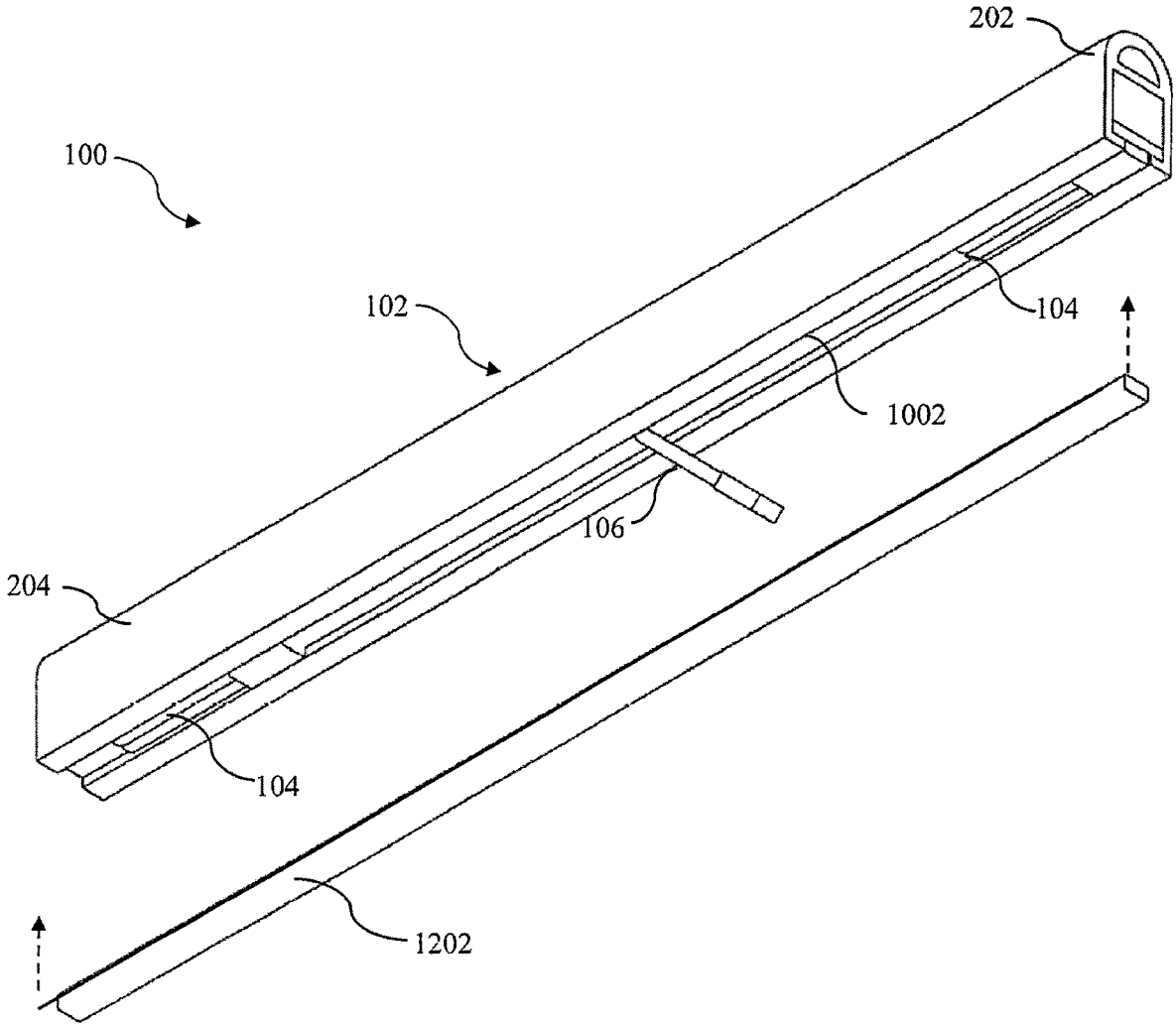
FIG. 13 is an illustration of another embodiment of the plurality of power conductors extruding at the bottom of the flexible LED illumination device.

FIG. 13 shows one embodiment of the flexible LED illumination device 100, where the plurality of power conductors 104 extrudes at the bottom in the same manner as the exposed power conductors 106. Initially, the plurality of power conductors 104 and exposed wire 106 are positioned horizontally at the bottom of the translucent positioning strip 1002. Afterward, silicon glue or potting material is filled to firmly secure the position, thus creating the potting glue 1202. The position of the plurality of power conductors 104 is arranged to be easily hidden during the installation process.

Figure 14:
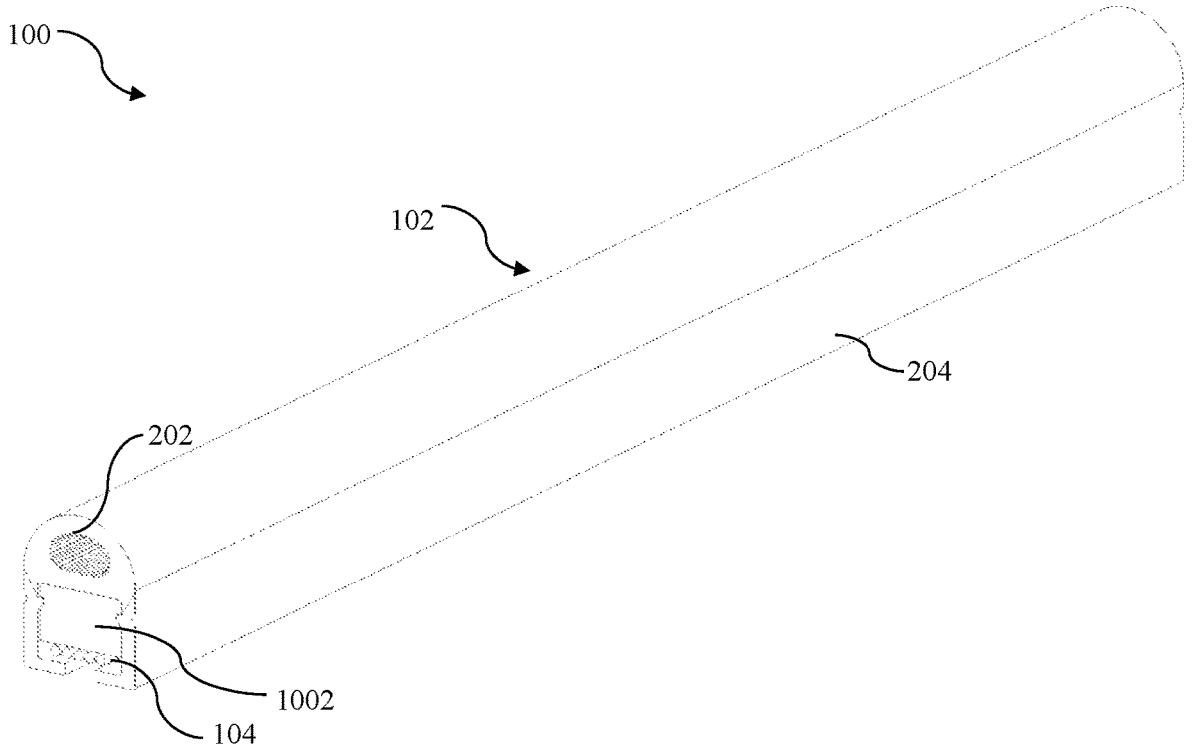
FIG. 14 is a perspective view of another embodiment of the plurality of power conductors with a quintet of conductors to accommodate the RGBW feature of the plurality of light modules.

In reference to FIG. 14, the illustration previews another embodiment of the present invention where the plurality of power conductors 104 comprises a quintet of conductors. Said quintet of conductors is structured to accommodate red, green, blue, and white backlight produced by the plurality of light modules. Also, the embodiment comprises translucent positioning strip 1002, translucent housing 204, elongated light diffuser tube 102, and potting glue 1202 (not shown).

Figure 15:
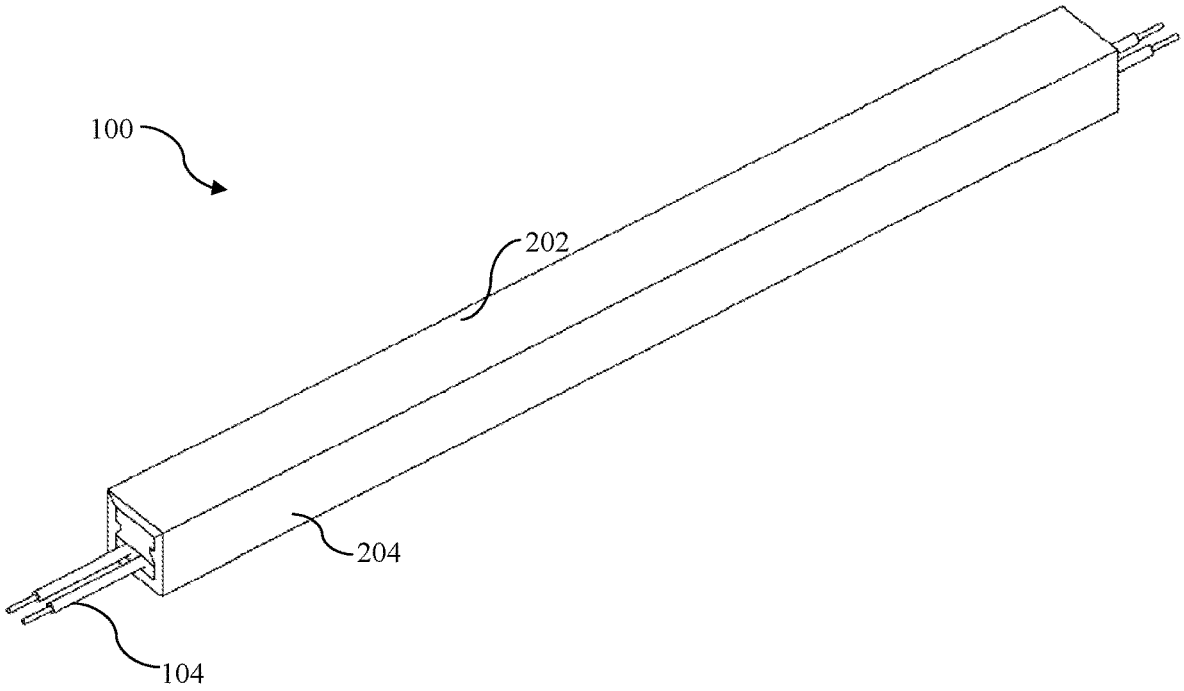
FIG. 15 is a perspective view of another embodiment of the flexible LED illumination device where the elongated light diffuser tube has a flat surface.
Figure 16:
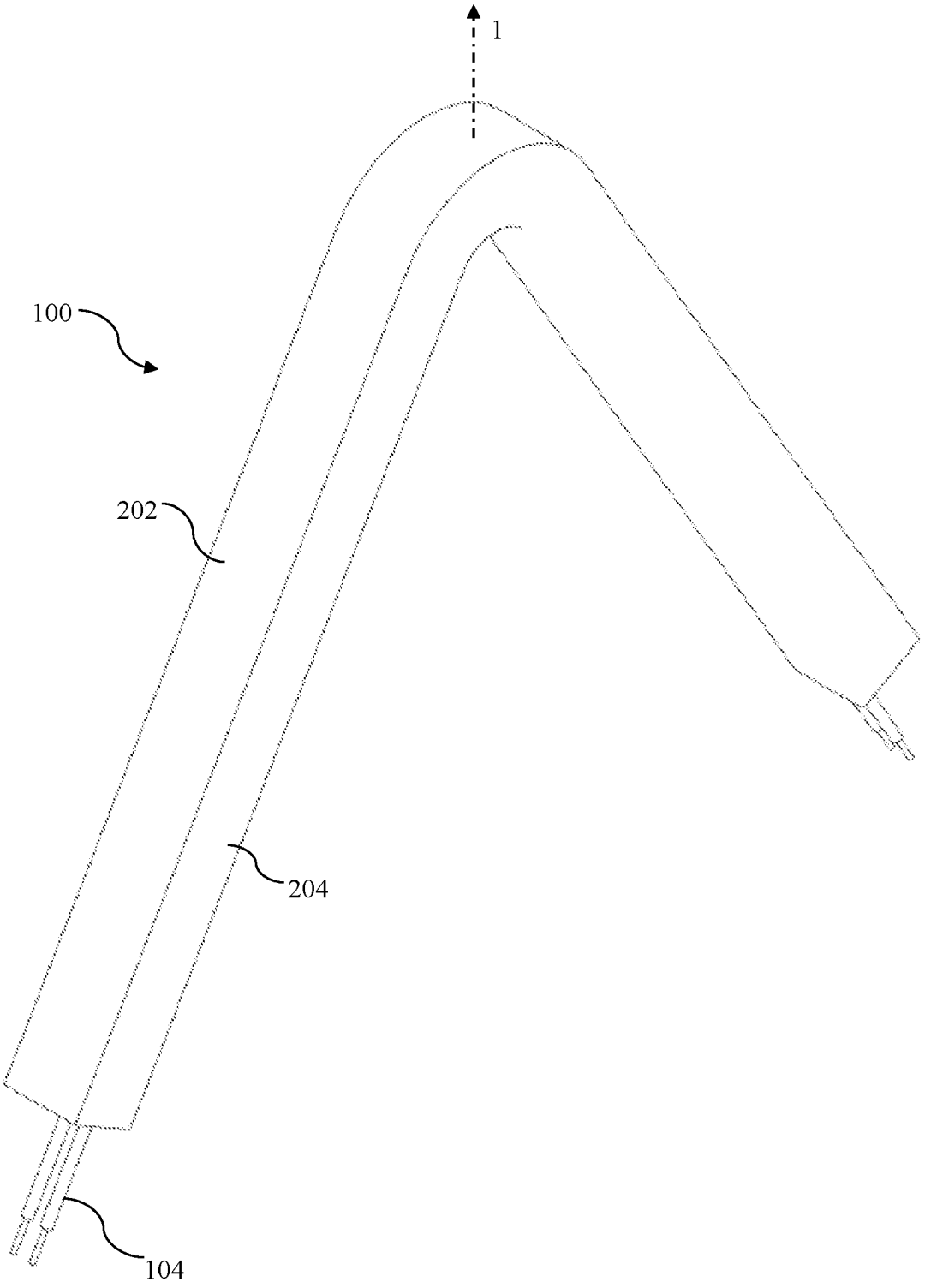
FIG. 16 is an illustration of the flexible LED illumination device being bent in a direction.

In the illustration provided in FIG. 15, said illustration shows another embodiment of the present invention where the elongated light diffuser tube 102 with a flat surface. The flat surface of the elongated light diffuser tube 102 for this embodiment allows the flexible LED illumination device 100 to be bent in the direction of 1, as shown in FIG. 16. Furthermore, the elongated light diffuser tube 102 is transparent allowing the light emitted from the plurality of LEDs 304 to be radiated.

Additional advantages and modifications of the present invention will readily occur to those skilled in the art in view of these teachings. The present invention, in its broader aspects, is not limited to the specific details, representative contrivances, and illustrative examples shown and described herein. Accordingly, various modifications may be made without departing from the spirit and scope of the general concept as defined in the appended claims and their equivalents.

What is claimed is:

1. A flexible LED illumination device comprising:

a translucent positioning strip having a plurality of slots disposed at a center thereof;

a plurality of light modules being securely mounted in the translucent positioning strip through the plurality of slots, and wherein said plurality of light modules further comprises a plurality of LEDs being mounted at a top surface of a circuit board, a power terminal for electricity connection being disposed at the bottom of the circuit board, and a current regulator mounted at a bottom of the circuit board;

a plurality of power conductors attached to the power terminal and said power conductors being configured to connect the plurality of light modules to a power source;

a translucent housing being molded to cover a top and sides of the translucent positioning strip and the plurality of light modules;

an elongated light diffuser tube disposed at a top of the translucent housing, and wherein said elongated light diffuser tube being configured to diffuse light from the plurality of LEDs simulating a neon sign;

a potting glue disposed at the bottom of the translucent housing and covering the plurality of power conductors;

an exposed wire extruding in between the plurality of light modules, and wherein said exposed wire is being configured for electrical connection means during installation thereof.

2. The flexible LED illumination device, according to claim 1, wherein said elongated light diffuser tube comprises an air gap disposed at a cross-center section thereof.

3. The flexible LED illumination device, according to claim 1, wherein said air gap is configured to diffuse and refract light emitted from the plurality of LEDs.

4. The flexible LED illumination device, according to claim 1, wherein the plurality of slots is molded to accommodate the plurality of light modules.

5. The flexible LED illumination device, according to claim 1, wherein the plurality of light modules is capable of emitting red, blue, green, and white lights.

* * * * *